US005727292A

United States Patent [19]

Vuillaume

[11] Patent Number: 5,727,292

[45] Date of Patent: Mar. 17, 1998

[54] INSTALLATION FOR THE PRODUCTION OF NONWOVEN WEBS, THE COHESION OF WHICH IS OBTAINED BY THE ACTION OF FLUID JETS

[75] Inventor: André Vuillaume, Bivier, France

[73] Assignee: ICBT Perfojet, France

[21] Appl. No.: 732,275

[22] PCT Filed: Feb. 13, 1996

[86] PCT No.: PCT/FR96/00227

§ 371 Date: Mar. 5, 1997

§ 102(e) Date: Mar. 5, 1997

[87] PCT Pub. No.: WO96/27040

PCT Pub. Date: Sep. 6, 1996

[30] Foreign Application Priority Data

Mar. 2, 1995 [FR] France ..... 95 02665

[51] Int. Cl.[6] ..... D04H 1/70

[52] U.S. Cl. ..... 28/104; 28/103; 28/167

[58] Field of Search ..... 28/103, 104, 105, 28/167, 165; 26/99, 72, 51; 68/205 R

[56] References Cited

U.S. PATENT DOCUMENTS

| | | | |
|---|---|---|---|
| 2,952,893 | 9/1960 | Kalwaites | 28/103 |
| 3,134,183 | 5/1964 | Duflot | 26/72 |
| 3,214,819 | 11/1965 | Guerin . | |
| 3,261,903 | 7/1966 | Carr | 26/72 |
| 3,508,308 | 4/1970 | Bunting et al. . | |
| 3,698,039 | 10/1972 | Kalwaites | 28/103 |
| 3,747,161 | 7/1973 | Kalwaites | 28/105 |
| 4,016,317 | 4/1977 | Kalwaites | 28/105 |
| 4,285,100 | 8/1981 | Schwarz | 28/103 |
| 4,665,597 | 5/1987 | Suzuki et al. | 28/104 |
| 4,879,170 | 11/1989 | Radwanski et al. | 28/105 |
| 4,939,016 | 7/1990 | Radwanski et al. | 28/104 |
| 5,136,761 | 8/1992 | Sternlieb et al. | 28/167 |
| 5,238,644 | 8/1993 | Boulanger et al. | 28/104 |

FOREIGN PATENT DOCUMENTS

| | | |
|---|---|---|
| 0337451 | of 1989 | European Pat. Off. . |
| 0400249 | of 1990 | European Pat. Off. . |
| 2068676 | of 1971 | France . |
| 2536432 | of 1984 | France . |

*Primary Examiner*—Amy B. Vanatta
*Attorney, Agent, or Firm*—Wall Marjama & Bilinski

[57] ABSTRACT

Apparatus for the production of a nonwoven material wherein a web of material is drawn over a series of parallelly aligned porous rolls. The web is treated with a jet of pressurized water as it moves in contact over each roll. The web is compressed between the first roll in the series and is wetted by a curtain of water as it is being compressed to increase the density of the web material prior to its being treated with the pressurized jets of water.

8 Claims, 2 Drawing Sheets

INSTALLATION FOR THE PRODUCTION OF NONWOVEN WEBS, THE COHESION OF WHICH IS OBTAINED BY THE ACTION OF FLUID JETS

BACKGROUND OF THE INVENTION

The present invention relates to an improvement made to installations allowing production of nonwoven fibrous webs, the cohesion of which is obtained by entangling the fibers in the thickness of said web by virtue of the action of fluid jets, and more particularly pressurized-water jets.

It was proposed a long time ago, as emerges from U.S. Pat. No. 3,214,819 and U.S. Pat. No. 3,508,308, to produce nonwoven textile webs in which the cohesion is given by the mutual interlacing of the elementary fibers, which interlacing is obtained by the action of pressurized-water jets which act on the fibrous structure in the manner of needles and allow some of the fibers making up the web to be reoriented into the thickness direction.

Such technology has now been extensively developed and is used not only to produce nonwoven fabrics for textile use, such as, in particular, for applications in medical or hospital fields, the field of wiping, of filtration, of envelopes for teabags, etc., but also for producing minute perforations in continuous supports, such as papers, cards, films, or even sheets of plastic or other materials, it being optionally possible for the articles obtained to have patterns in the form of hollows or raised areas, as emerges, in particular, from FR-A-2,068,676, FR-A-2,536,432 and EP-A-0,400,249.

Thus, as emerges from U.S. Pat. No. 3,214,819 which, to the knowledge of the Applicant, is the basic patent on this technology, the action of the water jets may be exerted in various ways on the article which is being treated, either, for example, on only one side of, it or successively on the two sides. However, the teachings provided by this document are essentially theoretical and the information given regarding the practical treatment conditions do not allow satisfactory industrial production. Thus, when it is envisaged to achieve bonding by acting alternately on one side and then the other, one of the steps in the treatment is performed through the fabric supporting the fibrous web. Such a way of operating results in very high absorption of the energy of the water jets by the supporting fabric, when it opposes the passage of said jets, as well as in disbonding of the fibrous structure from the surface of said supporting fabric, the jets pushing the fibrous structure back, causing the latter to elongate and creases to be formed.

Given these drawbacks, the installations proposed hitherto for carrying out a treatment on both sides of the basic product are of the type described in U.S. Pat. No. 3,508,308 (see, in particular, FIGS. 7 and 8 and the corresponding description) and are designed so that the fibrous base structure passes through a succession of interlacing zones proper, each consisting of a rotating perforated roll combined with a plurality of injectors (three successive injection rails for each rotating roll in the example illustrated) which make it possible, first of all, to act on one side of the product, then, by virtue of turning means provided between two successive rolls, to act thereafter on the reverse side and, optionally, to perform a third treatment on the right side before drying and taking up the product produced.

SUMMARY OF THE INVENTION

In general, the successive injection rails are set at different pressures depending on the articles to be produced, this pressure generally being between 300 and 100 bar or more.

However, such installations, which are satisfactory from the practical standpoint, have a number of drawbacks, among which may be mentioned:

they take up a lot of room lengthwise;

and, above all, they require the first series of interlacing treatments on one side to be carried out at a reduced pressure in order to prevent the fibers from emerging on the other side and creating defects; this is because, if the pressure is high, the fibers on the nonbonded side have a tendency to penetrate into the supporting fabric of the first roll; it is therefore necessary, in order to compensate for the lesser bonding effectiveness resulting from this reduced pressure, to increase the number of treatment injection rails (usually denoted by the term "injectors"), thereby appreciably increasing the cost of the installation, complicating the industrial operation and leading to high expenditure of energy and of water consumption.

An improved installation has now been discovered, and it is this which forms the subject of the present invention, which makes it possible to carry out such treatments using fluid jets providing cohesion to nonwoven fibrous webs which may be based on natural or man-made fibers, by themselves or as a mixture, or which are formed by nonwoven webs being combined with internal reinforcement, such as textile meshes, woven fabrics, knitted fabrics, cross-woven webs, longitudinal reinforcements, etc.

The installation in accordance with the invention makes it possible not only to tailor the treatment conditions to each type of textile structure much more easily, but also results in articles with a surface appearance much more uniform after action of the fluid and, above all, makes it possible, for equivalent articles, to operate with a reduced water consumption as well as a smaller number of passes under the interlacing injection rails.

Moreover, the installation in accordance with the invention also makes it possible to treat fibrous webs having a higher basis weight than conventional installations in which a series of successive inter-lacing treatments is carried out on each side of the article. This is because, in conventional machines, when the fibrous webs have a weight greater than 100 g/m$^2$, and in particular when they consist of low-denier fibers, it has been observed that surface appearance defects (raised or hollowed areas) were produced which renders them unsuitable for most applications.

In general, the installation in accordance with the invention comprises, in a known manner, means allowing a fibrous web to be produced, compressed and introduced into a treatment zone in which the moving web is subjected to the action of a succession of rails for injection of pressurized-water jets which act alternately on one side of said web and on the other, said installation being characterized in that the interlacing means are formed by at least one series of perforated rolls, each roll being combined with an injection rail (or injector) blasting pressurized-water jets against the surface of said web, said injection rails being arranged in a staggered fashion from one treatment roll to the next, the jets acting perpendicularly on the surface of the treated product and the peripheral speed of the rolls increasing slightly from one treatment roll to the next.

The increase in speed, from one treatment roll to the next, allows the web to be held under tension during the succession of treatment steps and results in the elimination of surface defects which appear on conventional machines. By way of indication, a speed increase of between 0.5 and 3% is suitable for most basis weights of webs treated.

According to one embodiment in accordance with the invention, the installation comprises four super-imposed treatment rolls each combined with one injection rail blasting pressurized-water jets against the surface of the material, the first roll in the production cycle being combined with means for densifying the untreated fibrous base web.

Such densifying means are essentially formed by a porous endless conveyor belt which supports the material and which bears tangentially against the surface of the first perforated rotating roll, inside which a partial vacuum is applied, and which therefore allows the base web to be compressed before it is subjected to the action of the first rail for injection of pressurized jets; in this embodiment, when the base web is compressed between the conveyor belt and the perforated rotating roll, said web is wetted by means of a curtain of water produced by means of an additional injection rail placed inside the volume defined by the conveyor belt, said curtain of water being directed against the surface of the latter and passing, in succession, through said porous belt and the compressed web before being sucked out through the perforated roll.

Although for most applications two successive treatments on each side, the right side and the reverse side, allows good results to be obtained, it may be envisaged, in a variant of an installation in accordance with the invention, to produce a second series of alternating treatments by means of a second set of superimposed perforated rolls and injectors which are placed opposite the first series of treatment elements.

By virtue of such a design, it is not only possible to obtain a very compact installation making it possible to carry out web-interlacing treatments which act alternately on each side of the base product but, moreover, it has been observed that, when such an installation comprised means for compacting with prewetting, it was possible to reduce the number of treatment injection rails compared to a similar product made on conventional installations in which several successive interlacing treatments are carried out on one side of the support and then on the other side.

Obviously it is not outside the scope of the invention to provide an installation in which the rolls are placed not in a superimposed manner but side by side, the injection rails or injectors acting, in accordance with the invention, alternately on each side of the fibrous web.

BRIEF DESCRIPTION OF THE DRAWINGS

The invention and the advantages which it provides will, however, be more clearly understood by means of the embodiment which is given hereinbelow by way of indication, but implying no limitation, and which is illustrated by the appended figures in which.

DESCRIPTION OF THE INVENTION

Figure 1:
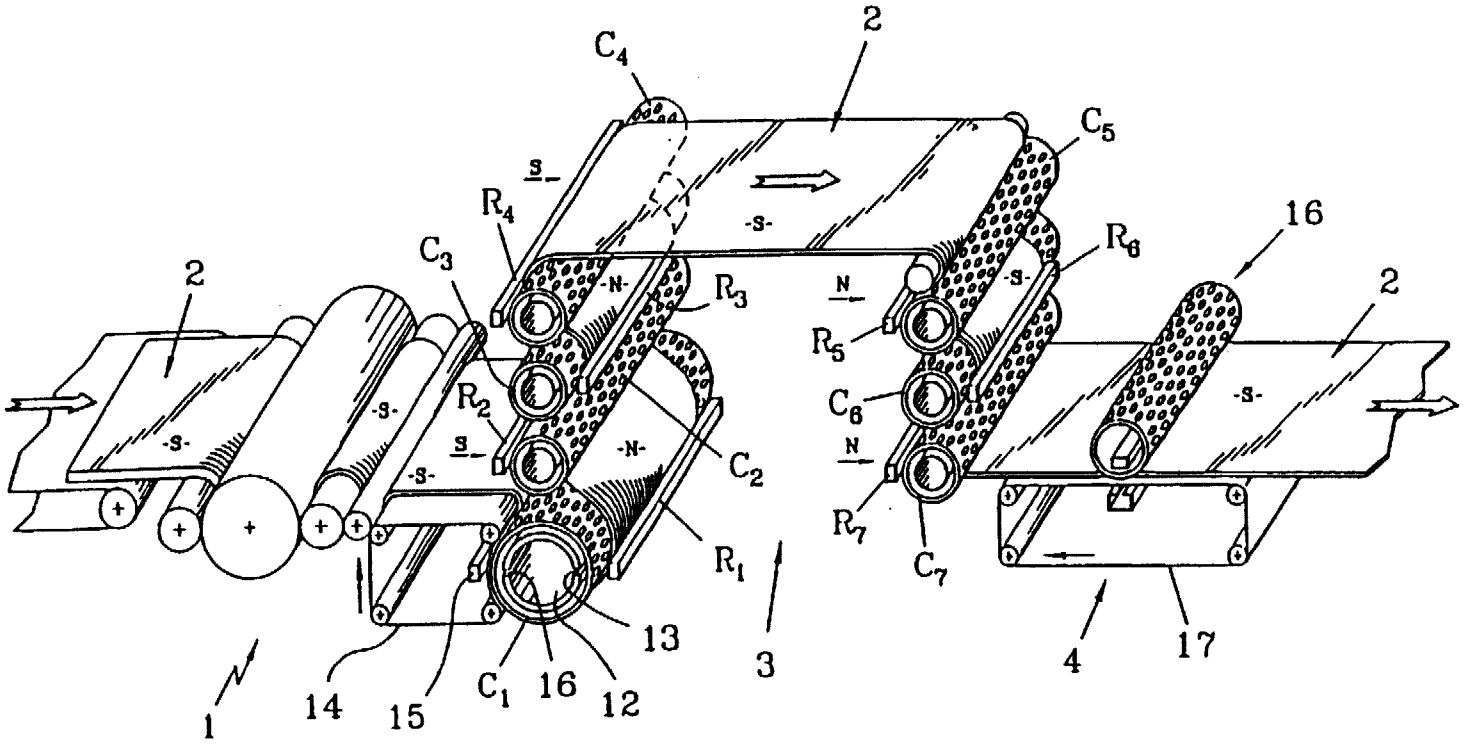
FIG. 1 is a diagrammatic perspective view showing the general structure of an installation produced in accordance with the invention.

Referring to the appended claims and more particularly to FIG. 1, the installation in accordance with the invention comprises, following the direction in which the article is produced, means denoted by the general reference number (1) which allow a fibrous web (2) to be produced, compressed and introduced into a treatment zone proper denoted by the general reference number (3), in which zone the moving web (2) is subjected to the action of a succession of rails for injection of pressurized-water jets, which injection rails, denoted by the same reference letter (R) but with an index, act alternately on one side (N) of said web (2) and on the other side (S), which web, after treatment, is taken up by an extraction unit, designated by the general reference number (4), in which a complementary treatment may be applied to it.

Thus, as emerges from the appended FIG. 1, according to one characteristic of the invention all the perforated rolls (C1, C2, C3, C4) of the treatment zone are mounted so as to be superimposed on top of one another, each roll being combined with one injection rail of injectors (R1, R2, R3, R4) blasting pressurized-water jets against the surface of the web (2), said webs being placed in a staggered fashion from one treatment roll to the next and the jets acting perpendicularly on the surface of the product to be treated. Moreover, the peripheral speed of the rolls (C1, C2, C3, C4) is set so that it increases progressively from one roll to the next in order to tension the web during the various treatment steps. Such a machine design therefore enables a treatment to be easily carried out alternately on the side (S) and on the side (N) of the product.

In the embodiment illustrated, a second series of perforated rolls (C5, C6, C7) combined with injection rails (R5, R6, R7) is placed so as to be parallel to and opposite the first series. This second series of injection rails is not essential and it might, optionally, be envisaged taking up the treated product immediately on leaving the final interlacing treatment zone formed by the roll (C4) and the injection rail (R4).

Figure 2:
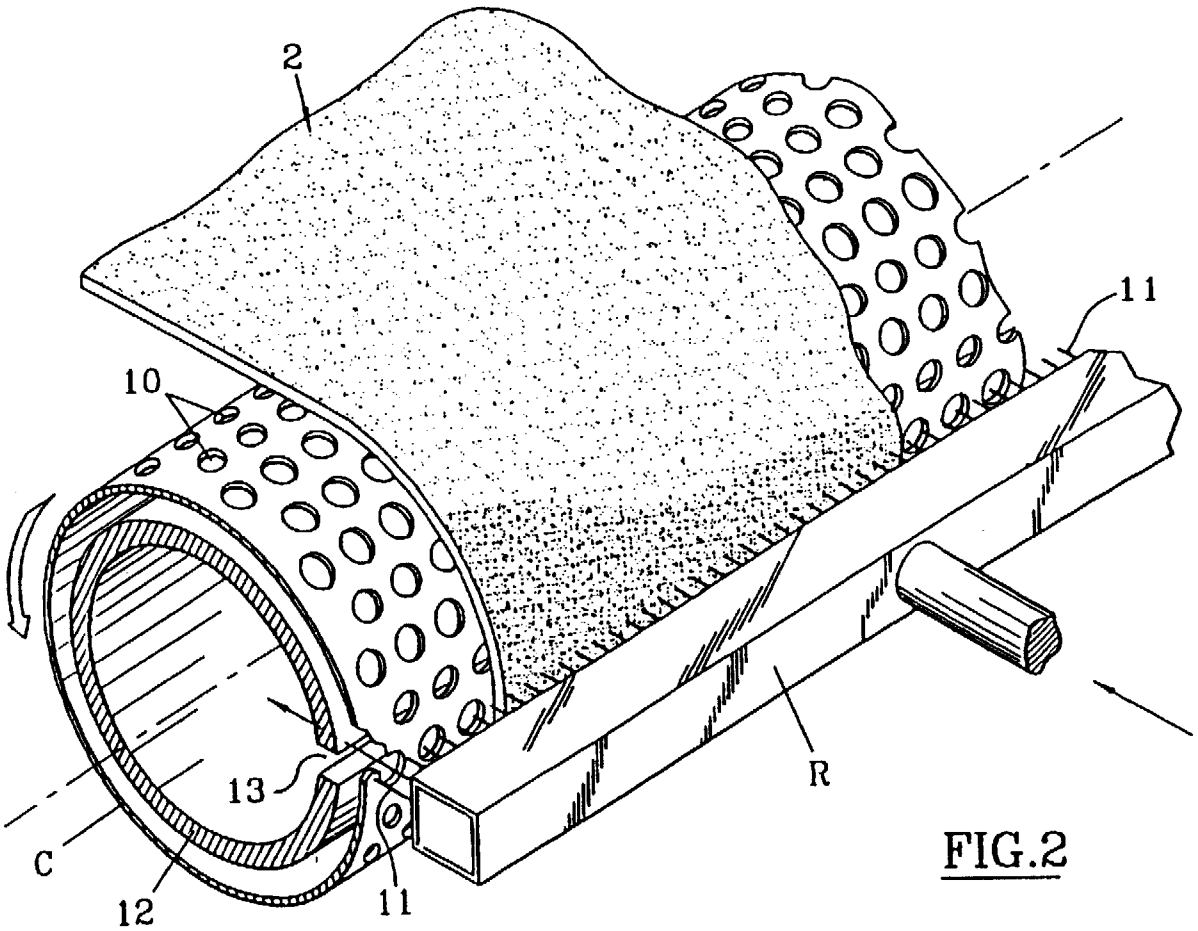
FIG. 2 is a detailed perspective view showing the structure of an elementary interlacing treatment zone of which such a machine consists.

Each treatment assembly (C) and injection rail (R) has a structure as illustrated in FIG. 2.

The perforated roll (C) is formed by a roll, preferably made of stainless steel, having a diameter of between 200 mm and 1,000 mm, and is rotated by any suitable means so as to have a peripheral speed equal to the speed at which the material (2) enters the installation. In general, this speed is between 10 m/min and 200 m/min and the increase in speed from one roll to the next is about 0.5 to 3%.

The perforations (10) of which the roll consists are of cylindrical or honeycomb shape, said roll being advantageously covered with a fabric made of steel monofilament or of plastic or with a perforated sheet having a porosity of between 3 and 20% (this element is not shown in FIG. 2). The injection rail or injector (R) which is placed so as to be parallel to a generatrix of the roll (C) is a conventional injection rail which creates water jets or needles (11) at a usual pressure of at least 30 bar, sometimes more, so as to entangle the elementary fibers of the web (2).

Such an injector may be designed in a manner similar to the teachings of EP-A-0,400,249.

Inside the roll (C) is placed a suction box (12) which is fixed, coaxial with the rotating roll (C) and connected to a suction source which allows a partial vacuum to be created inside said box. This fixed suction box (12) has, in alignment with the water jets (11), a slot (13) approximately 10 mm in width which allows the water passing through the fibrous web and through the perforated roll (10) to be sucked out.

In the embodiment illustrated in FIG. 1, the roll (C1) of the first treatment unit is designed not only to allow the interlacing operation, as explained above, but also to help to compress the untreated web before it is subjected to the interlacing treatment.

To do this, the roll (C1) has a diameter which is preferably greater than the diameter of the other rolls of the installation, this advantageously being between 500 mm and 1,000 mm. This roll bears against an endless porous conveyor belt (14) which allows the web to enter the treatment zone. This porous support has a speed synchronized to that of the roll.

It therefore makes it possible to compress the web (1) between the surface of the roll (C1) and its own surface before it is subjected to the action of the first rail (R1) for injection of high-pressure jets. It has been observed that it was advantageous to wet the web during this web-compression operation. To do this, an injection rail (15) is placed inside the volume defined by the conveyor belt (14), said injection rail creating a curtain of slightly pressurized water acting through the porous support (14)/compressed web (2) and perforated roll (1) combination. In order to allow the water passing through the aforementioned elements to be removed, a second slot (16) is provided on the fixed suction box (12), opposite the water injection rail. This extraction slot has a width of between 10 and 20 mm.

This wetting injection rail (15) forms a continuous curtain of slightly pressurized water and is placed opposite the porous support fabric (14) at a distance of between 10 and 100 mm from said porous support. The water pressure of these jets is between 3 and 15 bar, and preferably approximately 3 to 8 bar. Below 3 bar, the curtain disperses too quickly and above 15 bar the additional cost is not justified. It is important for the curtain of water emanating from this first injection rail to act perpendicularly to the base web, which is moving forward and being compressed, so as to wet it under optimum conditions.

On leaving the treatment zone (3), the dried web (2) is taken up, in a conventional manner, at (4), for example by means of an endless conveyor belt (17). In the take-up zone, the web (2) may undergo an additional treatment, for example a treatment allowing perforated patterns to be produced in the web by means of a unit (16) of the type described in European Patent 0,400,249.

The advantages provided by the installation in accordance with the invention will, however, be more apparent from the specific implementation example given hereinbelow.

EXAMPLE

A nonwoven web (2), based on polyester fibers having a linear density of 3.3 dtex and a length of 38 mm, weighing 200 g/m$^2$ and having a thickness of 8 cm is made to enter an installation as defined above. The entry speed of the web is 20 m/min.

This web is brought to the zone (3) proper by passing over a conveyor belt (14) having a porosity of 46%. The web is compressed between the first rotating roll (13) and said conveyor belt and is subjected to the action of a curtain of water produced by the injection rail (15), the outlet of which is at a distance of 100 mm from the internal surface of the conveyor belt (14). The pressure of the water emanating from the injection rail (15) is set to 10 bar.

The compressed web is then subjected to the action of the water jets emanating from the injection rails (R1, R2, R3, R4) which act alternately on the side (N) and the side (S) of said web.

The four injection rails (R1–R4) together produce 1,250 jets to the meter and are set in the following manner.

| Injection rail order | Jet diameter | Pressure | Roll speed in m/min |
|---|---|---|---|
| R1: side N | 140 m | 150 bar | C1: 20 m/min |
| R2: side S | 140 m | 180 bar | C2: 20.2 m/min |
| R3: side N | 140 m | 180 bar | C3: 20.4 m/min |
| R4: side S | 140 m | 180 bar | C4: 20.6 m/min |

Next, the web passes directly onto the take-up conveyor belt (4) without being treated in the second series of perforated roll jet [sic] combinations which is illustrated in FIG. 1.

Such a web has a very uniform surface finish, identical on both sides, and has the following mechanical properties, measured on a specimen 50 mm in width:

strength in the machine direction: 418 newtons strength in the cross direction: 1,066 newtons By way of indication, the production of a similar article on a conventional installation, in which several successive treatments are carried out on one side before treating the other side in a similar manner, the speed of the material being constant and set to 20 m/min, requires working under the following conditions:

| Injection rail order | Jet diameter | Pressure |
|---|---|---|
| 1st side, N, | | |
| No. 1 | 140 m | 150 bar |
| No. 2 | 140 m | 180 bar |
| No. 3 | 140 m | 180 bar |
| 2nd side, S, | | |
| No. 1 | 140 m | 180 bar |
| No. 2 | 140 m | 180 bar |
| No. 3 | 140 m | 180 bar |

The article treated under these conditions has similar mechanical properties but it is observed that some of the fibers reoriented during the treatment on the side N appear on the second side S which has a fluffed and non-uniform appearance. In addition, the planarity of the article is inferior to that of the article produced on a machine in accordance with the invention.

Moreover, the energy consumption necessary for bonding is, in a machine produced in accordance with the invention, about 0.65 kWh per kilogram of nonwoven while it rises to 0.94 kWh in the case of a conventional installation.

In addition, although the previous installations comprise only two perforated rolls each combined with a plurality of treatment injection rails, the installation in accordance with the invention requires as many rolls as treatment rails, the latter installation proving, however, to be less expensive since, in order to produce similar articles, it requires fewer treatment injection rails and less water consumption, with an energy saving of close to 50% and with a better final result being obtained.

Of course, the invention is not limited to the embodiment described and illustrated but covers all alternative embodiments produced within the same spirit, in particular those which would comprise perforated rolls placed parallel to one another as long as the injection rails blasting the water jets act alternately on one side of the treated fibrous web and on the other side and as long as the peripheral speed of the rolls increases progressively from one treatment zone to the next.

I claim:

1. Apparatus for the production of a nonwoven web of material that includes, means for drawing a web of nonwoven material along a given path of travel, a set of perforated rolls mounted in parallel alignment within a plane for contacting said web as it moves along said path of travel, said web being trained over said rolls so that the web moves in contact with the opposite side of each adjacent roll within a contact zone, an injection rail mounted adjacent the contact zone associated with each roll for directing a jet of pressurized water against the web as it passes through the contact zone, drive means for increasing the peripheral speed of the rolls progressively in the direction of web travel to tension the web between rolls.

2. The apparatus of claim 1 wherein each rail is arranged to direct a jet of water perpendicular to the web in the contact zone.

3. The apparatus of claim 1 wherein said rolls are aligned in a vertical plane.

4. The application of claim 1 wherein the drive means increases in speed of each adjacent roll between 0.5 and 3.0%.

5. The apparatus of claim 1 that further includes a densifying means arranged to act against the first roll in the alignment.

6. The apparatus of claim 5 wherein said densifying means further includes a porous endless conveyor belt for supporting said web thereon, said belt bearing tangentially against said first roll to compress the web between the first roll and the belt prior to the web entering the contact zone of the first roll, vacuum means for drawing a vacuum inside said first roll, water injection means inside said endless belt for directing a curtain of water at said web as it is being compressed, said curtain of water passing through the porous belt, the compressed web and the porous first roll.

7. The apparatus of claim 2 that further includes a second set of parallel aligned rolls downstream from said first set of rolls for contacting the web as it moves along said path of travel, said web being trained over said second set of rolls so that the web contacts the opposite side of each adjacent roll within a contact zone and secondary injection rails mounted adjacent each roll in the second set of rolls for directing a jet of pressurized water against the web as it passes through the contact zone.

8. The apparatus of claim 7 wherein said secondary injector rails are arranged to direct a jet of water perpendicular to the web in the contact zone.

* * * * *